US006086013A

United States Patent [19]

Looney, Jr. et al.

[11] Patent Number: 6,086,013

[45] Date of Patent: Jul. 11, 2000

[54] A-FRAME SPOOL CADDY

[76] Inventors: Lloyd R. Looney, Jr., 940 Ten Letter Ct., Kuna, Id. 83634; Joe V. Yrazabal, 11410 Overland Rd., Boise, Id. 83709

[21] Appl. No.: 09/108,860

[22] Filed: Jul. 1, 1998

[51] Int. Cl.[7] ..... B65H 49/00

[52] U.S. Cl. ..... 242/594.4; 242/598.5; 242/129.5; 242/129.6

[58] Field of Search ..... 242/129.5, 129.6, 242/129.62, 594.3, 594.4, 598, 598.3, 598.4, 598.5, 599.2, 599.3, 615, 615.2, 615.3

[56] References Cited

U.S. PATENT DOCUMENTS

| | | | |
|---|---|---|---|
| 384,626 | 6/1888 | Hilleary et al. | 242/594.4 |
| 442,309 | 12/1890 | Diamond et al. | 242/598 |
| 1,130,591 | 3/1915 | Gray | 242/598.5 |
| 1,648,998 | 11/1927 | Sherman | 242/599.2 |
| 2,551,190 | 5/1951 | Walker | 242/599.3 |
| 2,957,644 | 10/1960 | Beardslee | 242/139 |
| 3,050,273 | 8/1962 | Saundes | 242/615.3 |
| 3,383,071 | 5/1968 | Godson | 242/598.5 |
| 3,411,734 | 11/1968 | Greenberg et al. | 242/599.3 |
| 3,920,194 | 11/1975 | Parsen | 242/594.4 |
| 3,990,653 | 11/1976 | Marcell | 242/129.8 |
| 4,006,865 | 2/1977 | Howard . | |
| 4,030,704 | 6/1977 | Beierle et al. | 242/129.5 |
| 4,172,608 | 10/1979 | Brown, Jr. | 242/594.3 |
| 4,191,342 | 3/1980 | Reinhold | 242/599.3 |
| 4,304,369 | 12/1981 | Landsness | 242/599.3 |
| 4,391,422 | 7/1983 | McDonald | 242/129.6 |
| 4,533,091 | 8/1985 | Knight et al. | 242/129.6 |
| 4,548,368 | 10/1985 | Tomlinson | 242/129.6 |
| 4,564,152 | 1/1986 | Herriage | 242/594.4 |
| 4,585,130 | 4/1986 | Brennan | 242/129.6 |
| 4,611,645 | 9/1986 | Whisnant | 242/129.5 |
| 4,752,047 | 6/1988 | Franks, Jr. | 242/129.6 |
| 5,029,766 | 7/1991 | Emming | 242/129.6 |
| 5,096,072 | 3/1992 | Link | 211/132 |
| 5,224,518 | 7/1993 | Lefever et al. | 242/598.4 |
| 5,275,349 | 1/1994 | Tussing | 242/594.4 |
| 5,285,981 | 2/1994 | Pavelka . | |
| 5,316,232 | 5/1994 | Lambert, Jr. . | |
| 5,577,745 | 11/1996 | Birk | 242/129.5 |
| 5,732,899 | 3/1998 | Wells | 242/423.1 |
| 5,749,539 | 5/1998 | Ratzel et al. | 242/598.3 |
| 5,806,787 | 9/1998 | Schneider | 242/598.5 |

*Primary Examiner*—John P. Darling

*Attorney, Agent, or Firm*—Ken J. Pedersen; Barbara S. Pedersen

[57] ABSTRACT

A frame that folds to a compact, folded, generally flat shape, and that unfolds to an A-frame with spool-receiving bars hung preferably on both the front side frame and back side frame of the A-frame. The spool-receiving bars are removably received in the cradle spaces of open-topped brackets that extend from the frames. Preferably, no connection is made between the A-frame and the bar or spools, except that the bar rests securely in the brackets due to gravity. Each bar has at least one, and preferably only one, set of radial plates near one end. The plates are spaced to abut the sides of the bracket and/or the side surfaces of the preferred square tubing of the frame legs, so that the plates prevent axial movement of the bar so that the bar ends do not slide or fall out of the brackets. The plates may be sized to also act as a retainer for holding the spools from falling off of that end of the bar when the bar-spool unit is being removed from the caddy and transported or otherwise handled. The caddy is hinged at its top end, with the hinge axle extending through all four square tubing top ends, to create a strong hinge system and to allow the front frame or the back frame to at least partially pivot into, or "nest" in the other. Preferably, a wire guide connected to the A-frame pivots both to the front and back of the A-frame to universally serve as a partially-restraining and stabilizing guide for wire dispensing.

13 Claims, 8 Drawing Sheets

A-FRAME SPOOL CADDY

BACKGROUND OF THE INVENTION

1. Field of the Invention.

This invention relates to wire-carrying frames for easy dispensing of electrician's wire. More specifically, this invention relates to an A-frame wire caddy which may be set up for quick and stable dispensing of wire from multiple spools and may be folded to a compact and easily-stored shape.

2. Related Art.

Various holders have been designed for wire spools, in order to make access, handling, and unwinding of wire easier. Marcell (U.S. Pat. No. 3,990,653, issued Nov. 9, 1976) discloses a wheeled cart with turntable-style supporting bases upon which coils of wire are laid. Marcell includes a tray and tool box supports. Howard (U.S. Pat. No. 4,006,865, issued Feb. 8, 1977) discloses a system with wire dispensing reels for use with box wire. McDonald (U.S. Pat. No. 4,391,422, issued Jul. 5, 1983) discloses a spool carrier having a rectangular main frame and a wheel system depending from a mid-portion of the main frame for wheeling the main frame around. Knight (U.S. Pat. No. 4,533,091, issued August 1985) disclose brackets, which hold spool-carrying bars, for mounting on the support legs of a free-standing ladder. The Knight brackets have pivoting cylinders which receive the bar ends and allow the bars to pivot out away from one of the ladder legs for addition or removal of spools. Link (U.S. Pat. No. 5,096,072, issued Mar. 17, 1992) discloses a fold-out carrying device shaped generally like a step stool with baskets in place of the steps for carrying items. Pavelka (U.S. Pat. No. 5,285,981, issued Feb. 15, 1994) discloses a wire dispenser with a rectangular frame perpendicular to a wheel axle, and spool bars extending horizontally out from both sides of the rectangular frame. Lambert, Jr. (U.S. Pat. No. 5,316,232, issued May 31, 1994) discloses a horizontal, table-shaped wire dispenser frame with spool-holders inside the frame. Edgar (U.S. Pat. No. 5,732,899, issued Mar. 31, 1998) discloses a selectively rotatable wire reel unwinding assembly, which has a plurality of spool-holding branches extending out at various levels from a vertical post. Beardslee (U.S. Pat. No. 2,957,644) discloses a dispenser reel rack having two sides connected by an ear and cotter pin system. To connect the cross bars to the rack, Beardslee uses spring-biased pivoting sleeves that surrounds a leg of one of the sides.

Still, there is a need for an improved wire spool holder and dispenser that is economical to manufacture and convenient to use. There is still a need for such a holder-dispenser that is compact and foldable, and that has a minimum of parts and structure.

SUMMARY OF THE INVENTION

The invention comprises an improved wire spool caddy for holding and dispensing wire or other strands wound around spools. The invented spool caddy comprises an A-shaped frame having a front side and a back side pivotally connected preferably on a single axis through their tops. The single pivotal axis is coplanar with the planes of the two sides, and one of the two sides is sized to "nest" at least partially inside the other, so that the caddy folds into a very compact and thin unit. When in use the caddy unfolds to a stable, broad-based A-frame.

On at least one of the two sides of the caddy, and preferably on both, there is at least one easily removable spool-receiving bar. Each spool-receiving bar slides into two brackets, one on each of the two legs of the A-frame side which is to hold the bar, so that each bar can rotate on its axis in the brackets. The bar slides down into the brackets parallel to the front surfaces of the legs to be held securely until the user applies enough upward force to lift the bar and its spools up out of the brackets.

Preferably, two spaced, parallel plates or other protrusions extend out from one end of each bar for contacting both sides of one of the brackets, to act as a lock for preventing the bar from sliding horizontally in the brackets. Also, the bar and plate diameter are sized so that one bar end and the main body of the bar fit through the spool central opening so that the spools will not slide off the other end of the bar because of the protruding plates. Thus, the bar may act as a "skewer" to hold one or more spools separate from the caddy for easy transport and handling, and then the bar with its spools may be conveniently set down into the brackets of the caddy for use. When the wire is used up or a different size or type of wire is needed, the bar and its spools may be lifted again for replacement with a different bar and spools or with different spools on the same bar.

Preferably, the front side has two bars with four associated brackets, with the two bars preferably being substantially identical and the four brackets being substantially identical and identically spaced, so that the bars may be interchanged and also may be turned around end-to-end. Preferably the back side has one bar with two associated brackets located fairly low on the back side, so that its spool(s) do(es) not interfere with the spools of the front side. The back side bar may be turned around end-to-end, but is typically of a different length from the front side bars and so may not fit in the front side brackets.

Preferably, the caddy includes a wire guide that receives, directs, and creates a reasonable amount of tension on the wire extending out from the wire guide to the point of use. The caddy preferably is adapted to slide laterally on, and pivot around, the folding axis of the caddy, to allow the guide to reach appropriately toward all the spools on the caddy.

DESCRIPTION OF THE PREFERRED EMBODIMENTS

Figure 1:
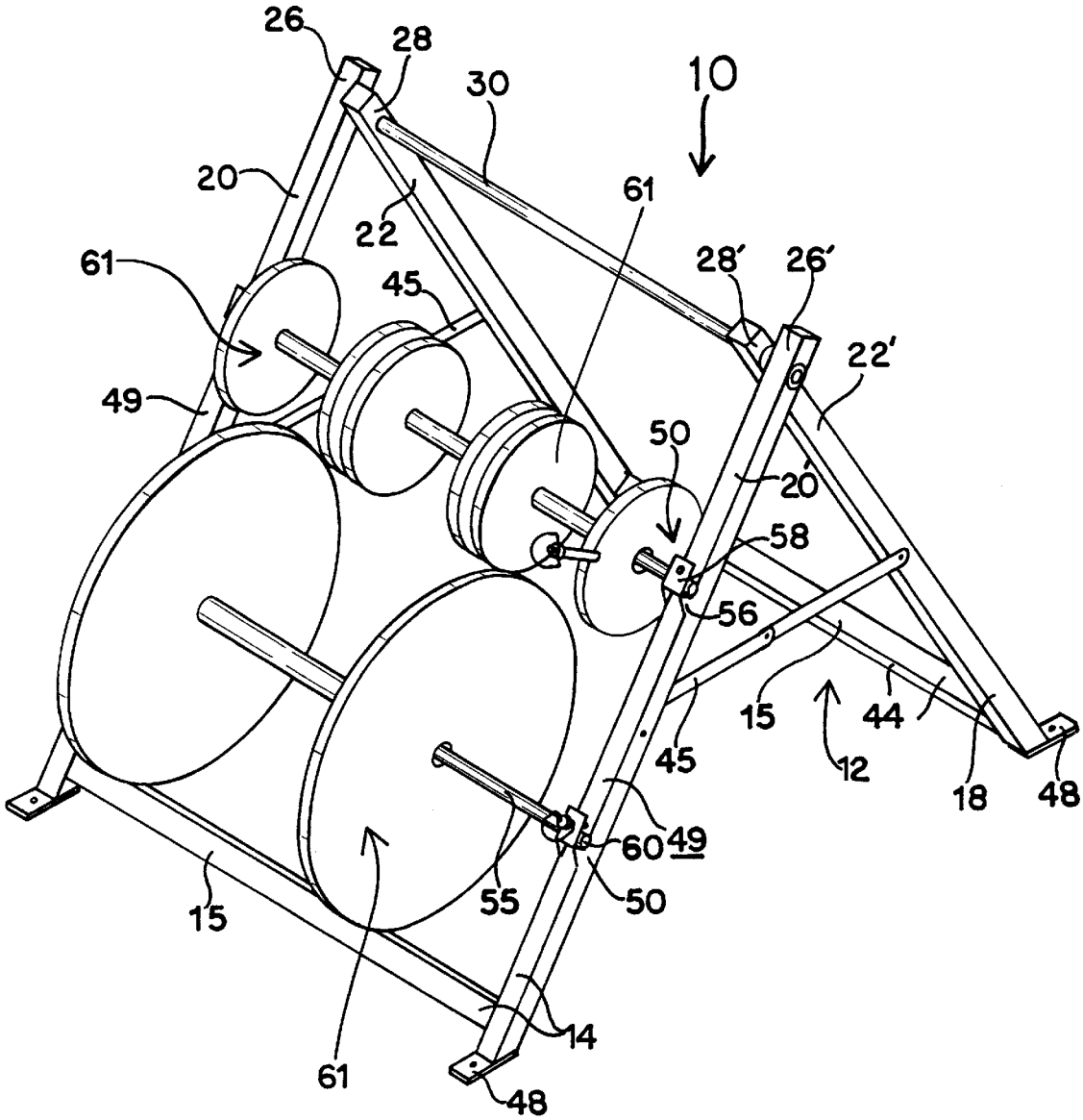
FIG. 1 is a perspective view of one embodiment of the invented spool caddy, holding one large and three small spools (wire not shown).

Referring to the Figures, there are shown several, but not the only, embodiments of the invented wire holder/ dispenser, herein called a "caddy". The preferred caddy 10 comprises an A-shaped frame 12 having front frame 14 and back frame 18. Preferably, the front frame 14 and the back frame 18 are each constructed of square, hollow tubing that is welded, bent, or otherwise formed into generally a three-sided rectangular shape opening at the top and having an open space for receiving the spools 61. Each frame 14, 18 therefore has a horizontal base member 15, 15', and two spaced, vertical legs 20, 20', 22, 22' at the ends of the base members. Each of the two frames 14, 18, have two top ends 26, 26', 28, 28' and all four of these ends pivot on a single axis created by an axle 30 rotatably inserted through bores 32, 34, in the ends.

Figure 2:
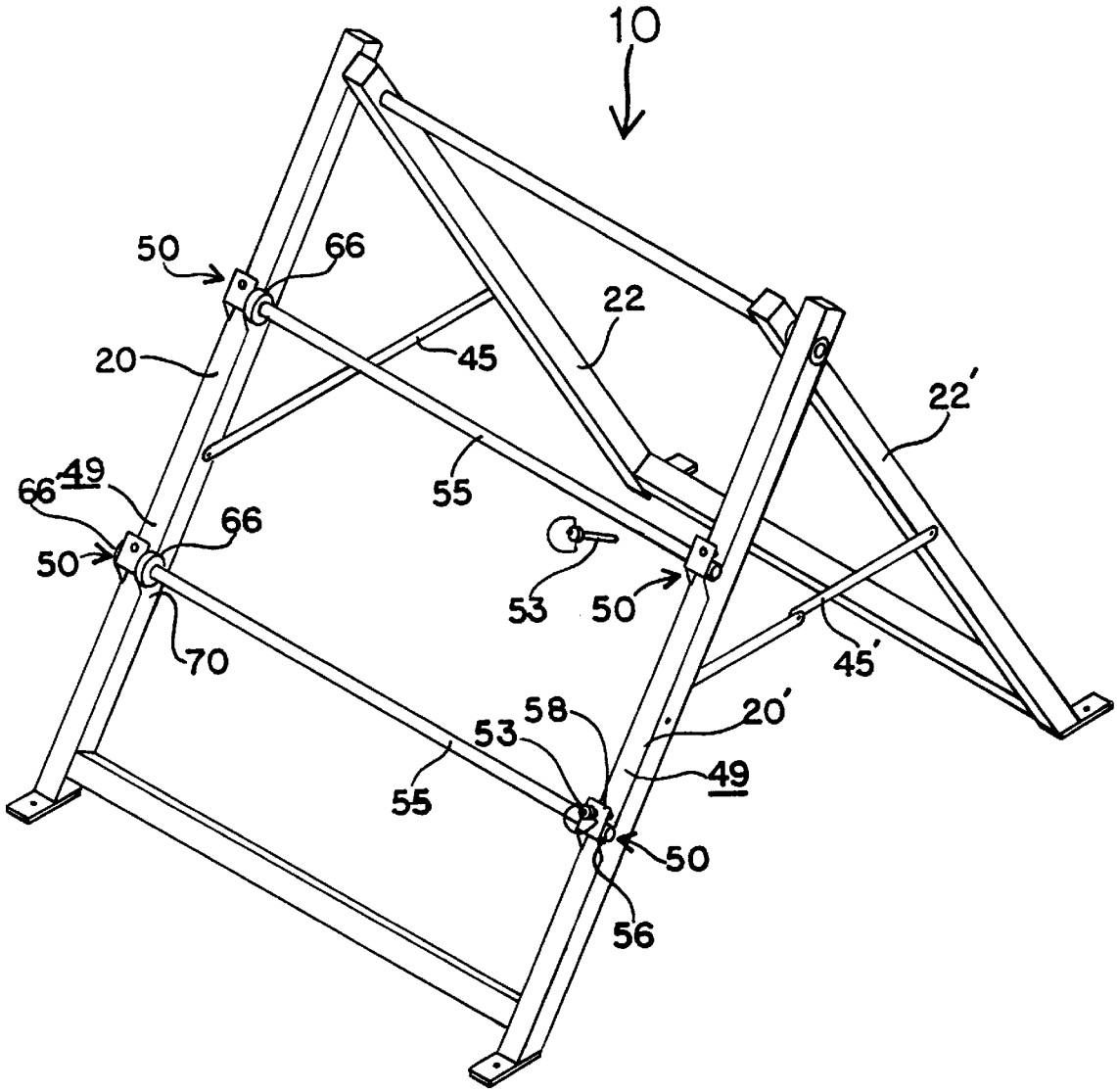
FIG. 2 is a perspective view of the embodiment of FIG. 1, without the spools.
Figure 4:
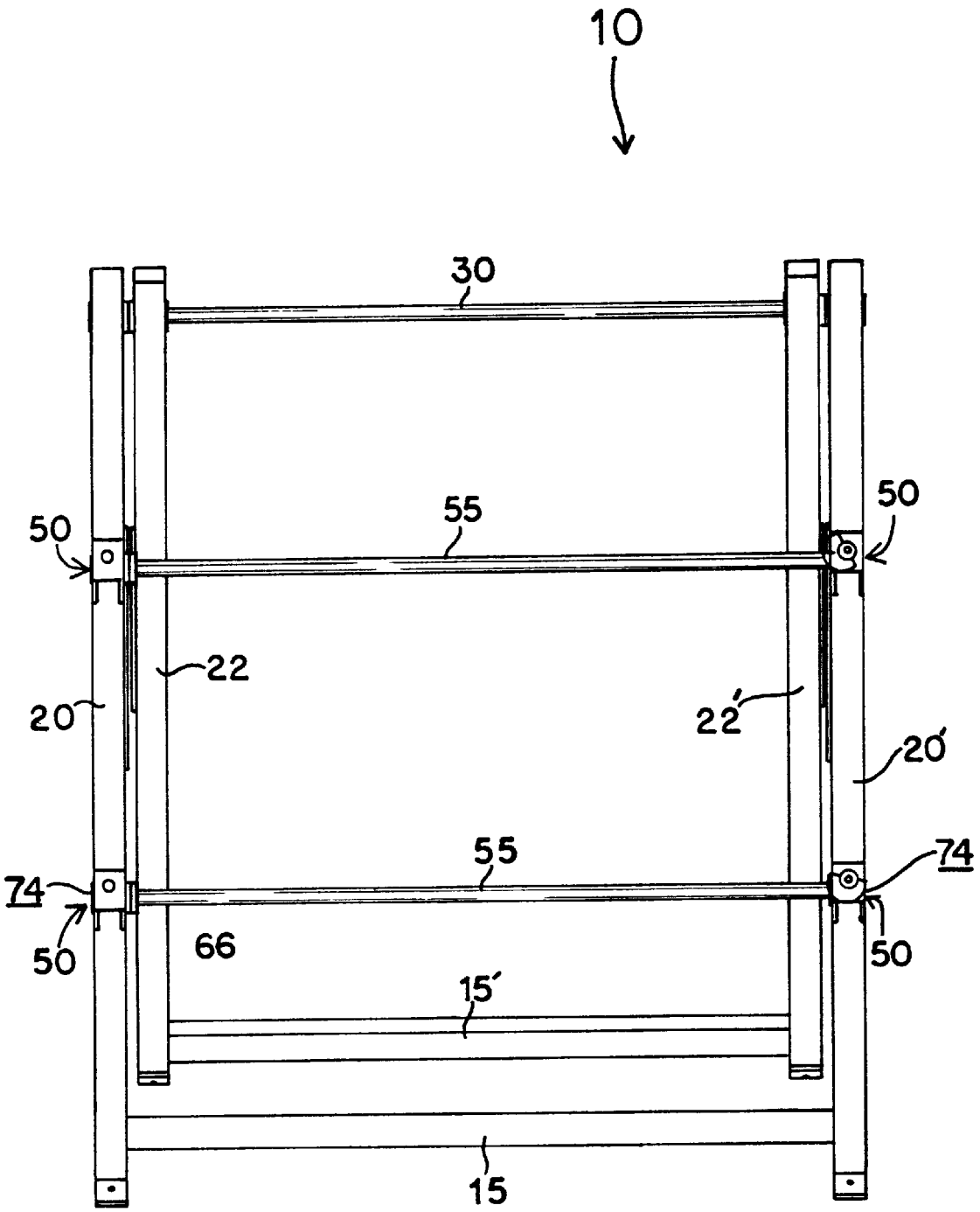
FIG. 4 is a front view of the embodiment of FIG. 2.
Figure 5:
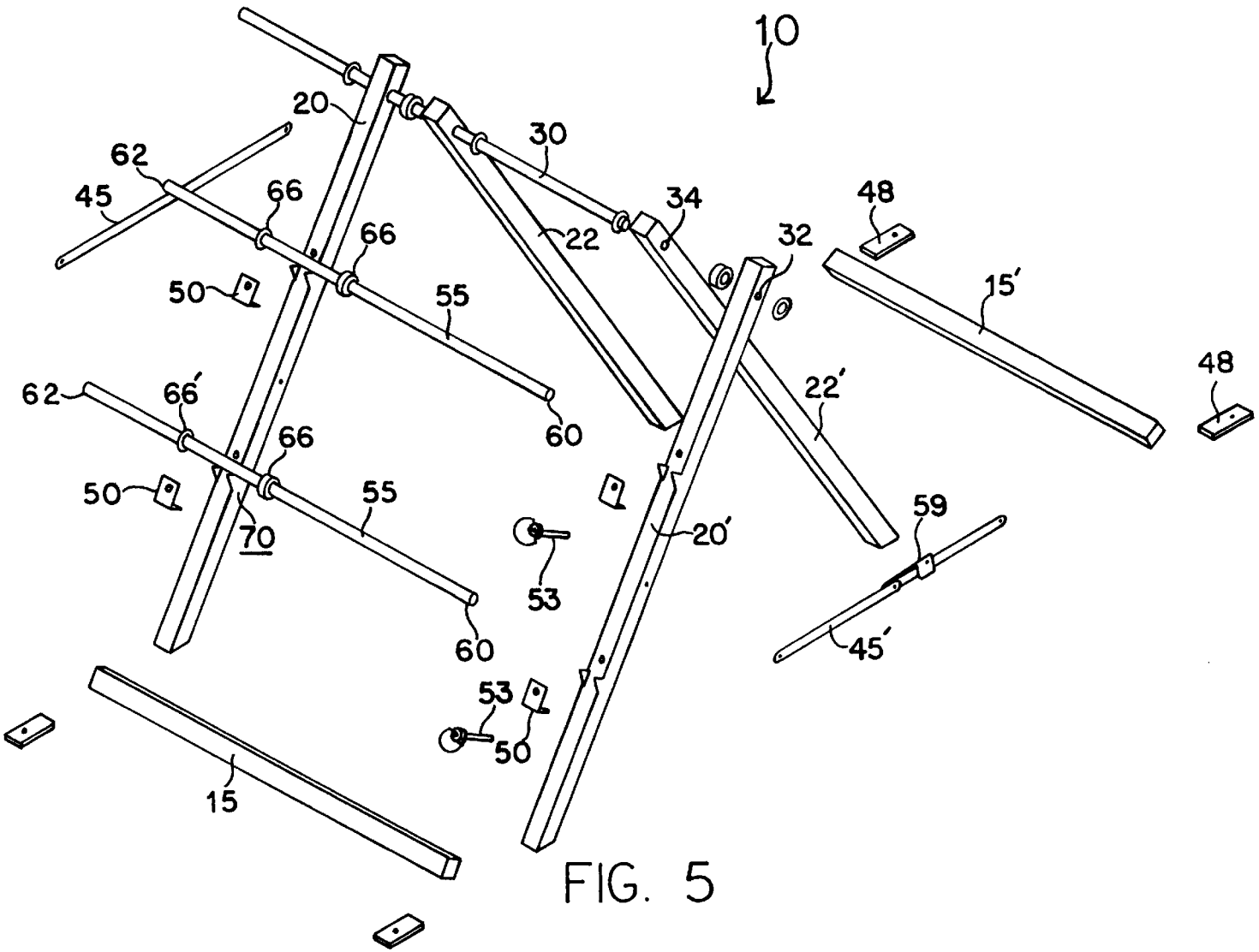
FIG. 5 is an exploded perspective view of the pieces parts embodiment of FIG. 2.

In the embodiment shown in FIGS. 1, 2, and 4, the front frame 14 is wider than the back frame 18, that is, the base member 15 is longer than the base member 15' of the back frame and the legs 20, 20' are more distantly spaced than the legs 22, 22' of the back frame 18. The front frame top ends 26, 26' therefore are positioned outside the back frame top ends 28, 28'. The length of the front legs 20, 20' may be the same as the back legs 22, 22', in which case, the front frame typically folds (pivots) at the axle to place the front frame close to the back frame, with approximately the upper ⅓ of the back frame "nesting" inside the plane of the front frame and the front base member 15 back surface 42 near the front surface 44 of the back base member 15' (See FIG. 6). Optionally, the back legs may be shorter than the front legs and the entire back frame may be adapted to lie in the plane of the front frame when the caddy is collapsed. If this complete "nesting" is desired, other members (such as side locks 45 and feet 48) may be designed to not interfere with the front and back frames lying in the same plane.

On the outer surface 49 of each of the front legs is attached a bracket 50, which extends outward and upward to form an open-sided U-shaped receptacle for a spool-receiving bar 55. Each bracket 50 is formed, therefore, of a bottom portion 56 and upright portion 58 having the same width and having generally flat and broad inner surfaces. Although only one pair of brackets is required, two sets spaced apart to be generally in the top half and the bottom half of the front frame are preferred.

Each bar 55 for receiving spools 61 is a round bar with a consistent outer diameter all the way from a first end 60 up to the second end 62, except for two protruding plates 66, 66' or other fairly thin radial protrusions. These plates 66, 66' extend radially from the bar 55, that is, perpendicularly to the axis of the bar, and are spaced apart an axial distance slightly greater than the width of the bracket 50. The plates therefore act like "fins" extending out all the way around the bar, and preferably are round plates that are both coaxial with the bar. When the bar 55 is inserted down into the brackets 50, the bar is aligned with one of the brackets so that the two plates 66, 66' straddle the bracket, that is, the bar slides down into the bracket with one plate on each side of the bracket. The plates 66, 66' are large enough in diameter that they extend forward past the bracket upright portion 58 and backward along the side surfaces 70 of the front leg 20. Thus, the plates 66, 66' act as stops to prevent any significant horizontal (axial) movement of the bar.

Preferably, the inner plate 66 is thicker than the outer plate 66'. The inner plate 66 acts both as a "lock" or limit against axial movement of the bar, but also is designed to be about ½–1 inch thick to serve as a spacer between the legs of the frame and the spools upon the bar. This improves operation during dispensing of the wire, by preventing binding of the spool on the frame leg. The electrician may push the spools towards the plate 66 and know that they will not bind on that leg.

The invented bracket and plate system serves to secure the bar during dispensing from the caddy, while providing an improved system for spool removal and handling. The bar 55 stays safely in place, without a significant chance of the bar and its heavy spools sliding and falling down from the frame 14, because the bar is "locked" in the bracket 50 by the plates 66, 66', because of the weight of the wire spools, and because of optional pins 53. However, the bar 55 is removable from the brackets whenever the user chooses to do so, because there are preferably no bolts, no screws, and no connections between the bar and the frame 14, except for the bar resting in the cradle of the brackets 50, and the easily-removable, slide-out pins 53. Each pin 53 may be inserted above the bar 55 through a hole in the bracket upright portion and a corresponding hole through the leg. The pin 53 is frictionally-engaged in the holes until the user purposely pulls out the pin. The pins may each have a chain connecting them to the A-frame, to prevent loss of the pins and to provide more convenient access and use of the pins.

The bar 55, and brackets or other holders for holding each bar on the caddy, preferably does not comprise any collar or other portion that encircles any part of the frame 14, and the bar preferably does not have any pivotal connection to the frame. The frame preferably does not comprise any spring or biasing system, any pivoting brackets for receiving the bar, or any structure that extends out to abut the end surfaces 74 of the bar. Thus, the invented bracket and plate system is simple, efficient, and safe to use, and requires a minimum of structure and manufacture.

Preferably, the two brackets of each of the two sets on the front frame 14 are approximately equidistant from each other, so that two bars 55 of the same dimensions may be interchanged in these bracket sets. Also, the brackets are all identical, so that the bar may be turned end-to-end depending on the convenience and comfort of the user as he/she installs the bar and spools on the caddy 10.

Figure 6:
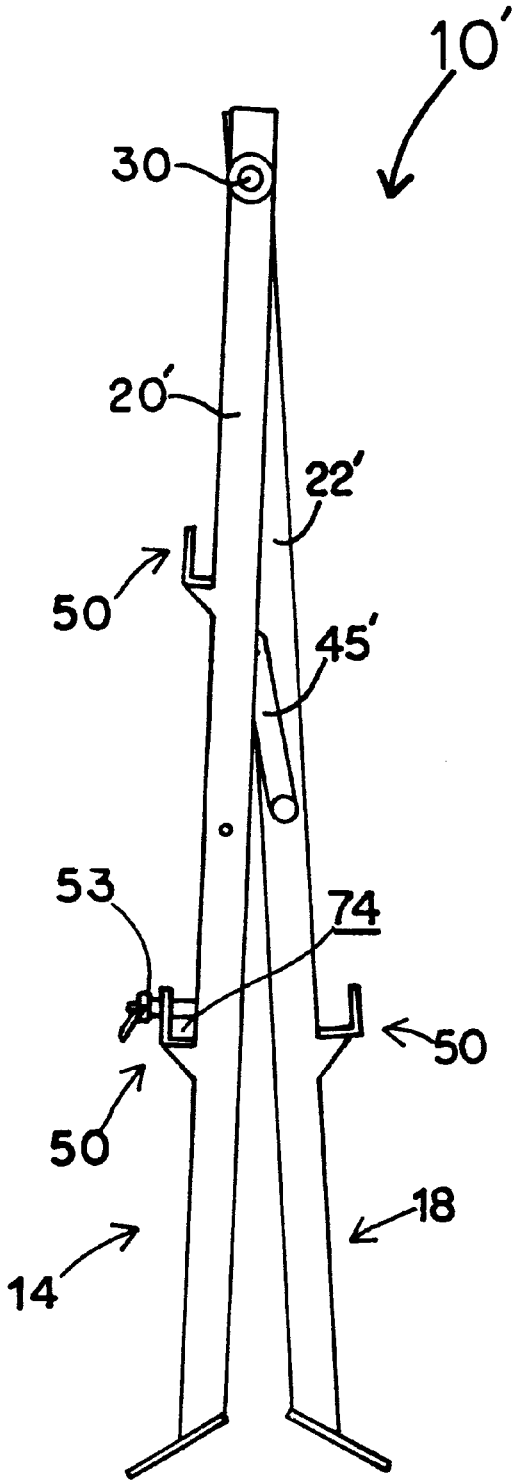
FIG. 6 is a right side view of the embodiment of FIG. 2, folded into a compact, flat state.

On the back frame 18 of some embodiments 10', as shown in FIG. 6, there may be one set of brackets 50, generally at the same level or higher (preferably ½ inch–4 inches higher) than the lower brackets on the front frame 14. This allows a third spool or grouping of spools to be hung on the back frame 18, without these spools interfering with the rotation/unwinding of the first two sets of spools that are on the upper and lower halves of the front frame. Because the front and back frames are spread widely apart when the caddy 10 is unfolded and set up, there is adequate room between the lower front bar and the lower back bar to accommodate several large spools.

Other bracket configurations are contemplated. For example, transverse holes through the frames for receiving the bars may be used. Also, a set of adjustable brackets clamped or pinned to the frame may be used.

Because the legs of the front and back frames are different distances apart, the bars for the front frame will typically be of a different length than the back bars, and, therefore, the front and back bars may not be interchangeable. However, as an option, all the bars may be long enough to cooperate with the widest frame, whether it be the front or back frame, and therefore add another degree of flexibility.

Figure 3:
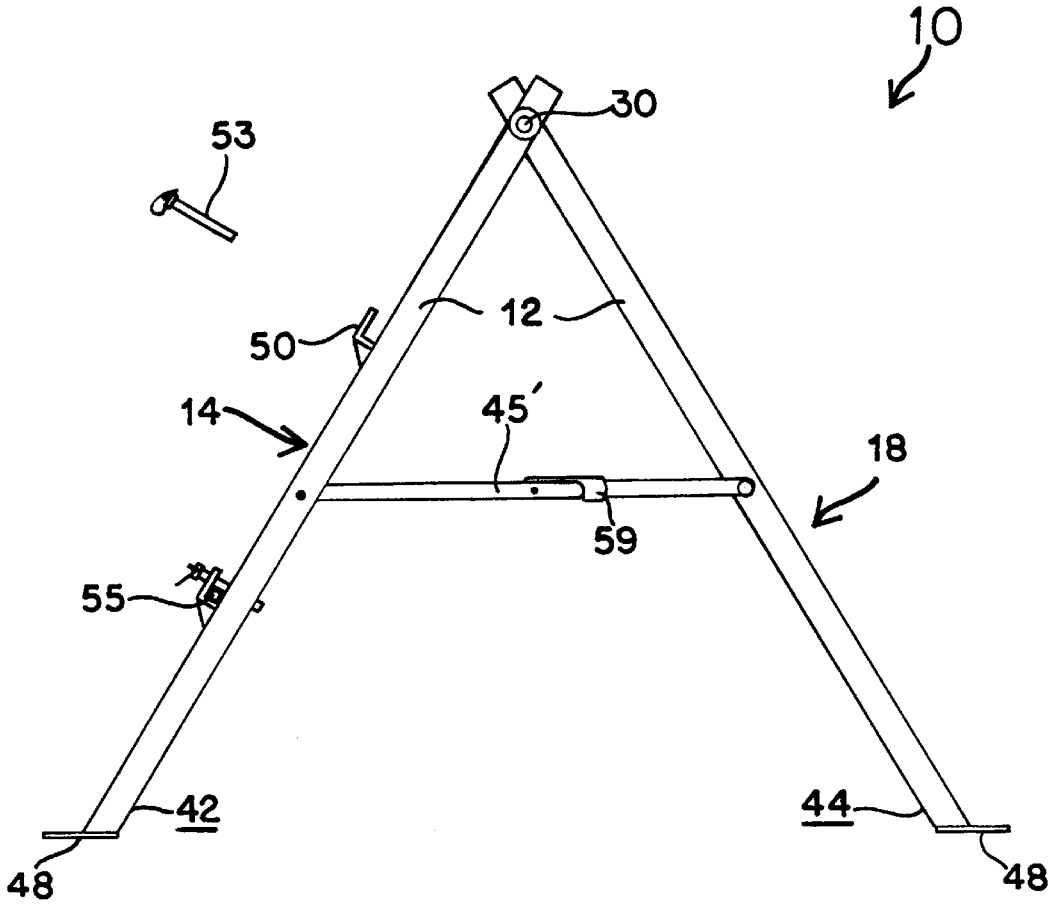
FIG. 3 is a right side view of the embodiment of FIG. 2.

In order to limit the pivoting of the front and back frame around the axle 30, one or more side locks 45 or other connecting limit mechanisms are used. The preferred side locks 45 have two portions that pivot relative to each other and to the front and back frames to which they are attached. When the side-lock portions are aligned on the same longitudinal axis, the front and back frames 14, 18 are pivoted apart to a maximum extent, as shown in FIG. 3. This maximum extent places the A-frame at an angle with the ground that approximates an equilateral triangle. An additional locking mechanism 59 may be used to further ensure the side locks do not move except as manually controlled by the user.

The A-frame may therefore typically rest on the ground, floor, truck-bed or other surface with its hinged angle being at about 60 degrees (FIGS. 1, 2, 3). The feet may be bolted down, if desired, to further stabilize the caddy. When folded into the folded position, as shown in FIG. 6, the hinged angle is preferably in the range of about 0–15 degrees, with the 0 degree case being for a caddy that is designed for one of the frames to fully nest inside the other, and the larger angle cases being for caddies which fold to a fairly flat unit but with the two frames not in the same plane.

Figure 7A:
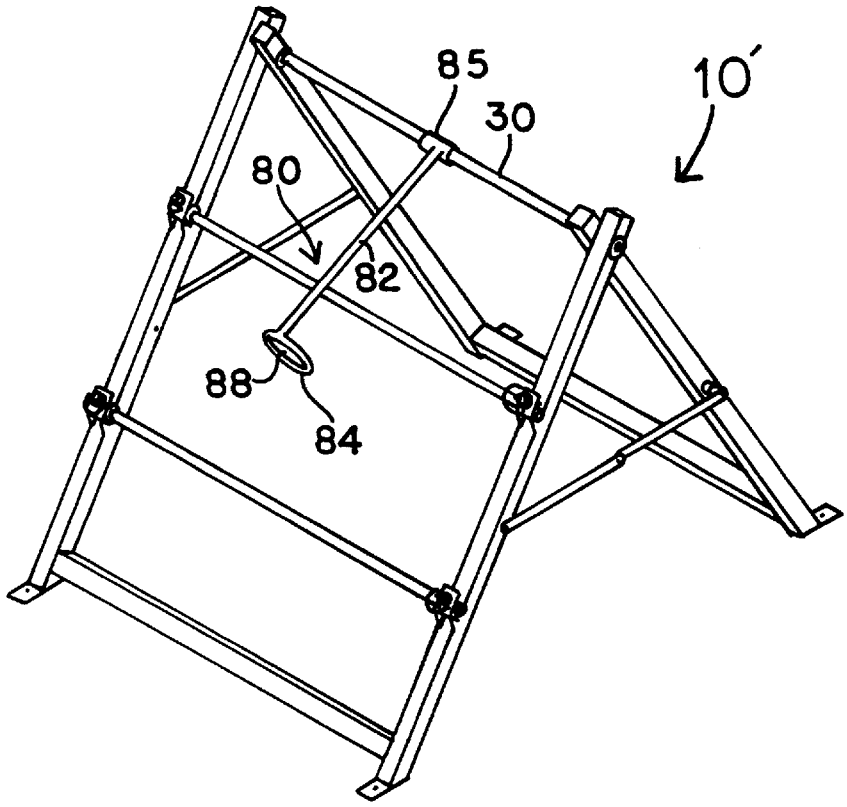
FIGS. 7A and 7B are perspective views of an embodiment of the invented spool caddy with a wire guide, the caddy being fully unfolded in FIG. 7A and partially folded in FIG. 7B.
Figure 7B:
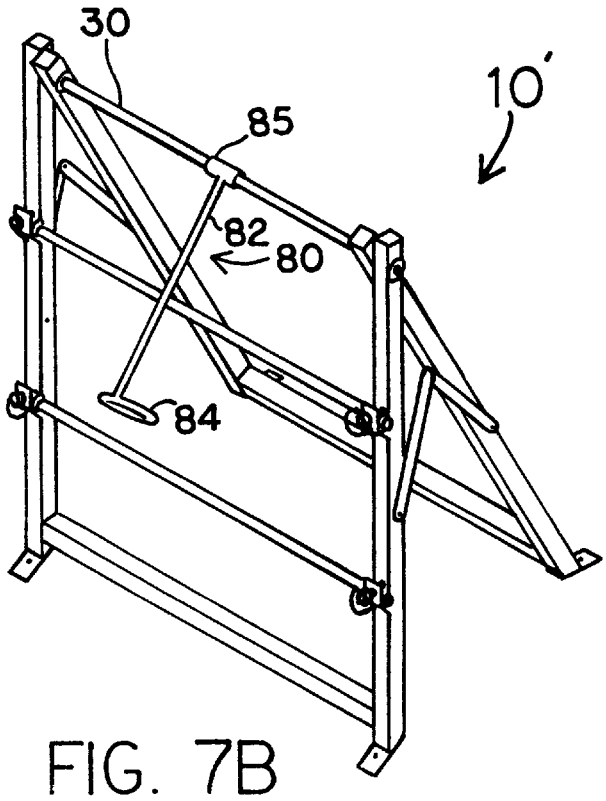
Figure 8:
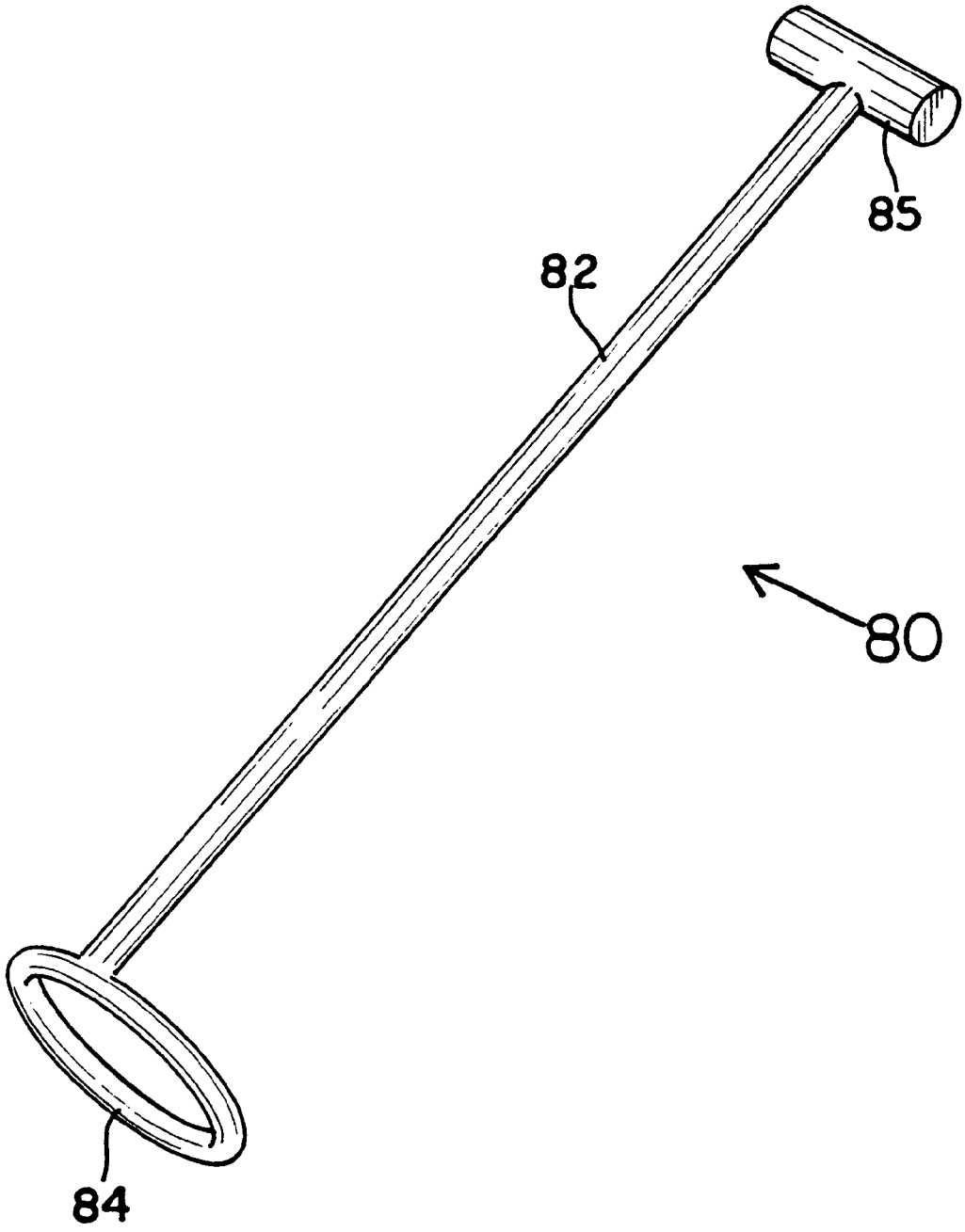
FIG. 8 is a detailed view of the wire guide of FIGS. 7A and B.

An especially-preferred embodiment, shown in FIGS. 7A and B, includes a wire guide 80 pivotally connected to the caddy 10'. The guide includes an extension 82 and a ring 84, and a sleeve 85 that slidably surrounds the axle 30 to connect the guide 80 to the axle 30. The extension 82 is long enough to place the ring 84 at about the middle of either of the front or back frames, because the guide 80 may be pivoted about 360 degrees to lie either against the front frame or the back frame, preferably with the ring about midway between the axle 30 and bottom of the A-frame. In use, a wire from a spool is directed through the aperture 88 of the ring, so that, as the wire is pulled from the spool, the wire travels through the ring. The guide tends to have a stabilizing influence on the wire movement, directing it in generally a straight line from the spool to the ring and placing some tension of the wire to prevent wild, unpredictable movement or excessive "spinning" of the spool while the wire is pulled, especially when the wire is pulled at varying rates and at varying angles to the caddy. The guide may be slid along the axle, and it tends to naturally slide to a position where it is aligned with the center of a spool from which the wire is being unwound. The guide may be of other shapes, but should preferably guide the wire without binding or crimping it, and should preferably pivot or swing to a variety of locations for use with spools placed in different positions on the caddy. Also, the guide should pivot/swing/fold out of the way to be generally flat or compact against the A-frame, to make storage convenient.

Another preferred embodiment includes a caddy configuration switched so that the front frame (having two bars) is smaller than the back frame, if desired, and then the front frame top ends would pivot inside the top ends of the back frame. Also, the arrangement and number of bars may be altered.

Although this invention has been described above with reference to particular means, materials and embodiments, it is to be understood that the invention is not limited to these disclosed particulars, but extends instead to all equivalents within the scope of the following claims.

We claim:

1. An A-frame spool caddy comprising:

an A-frame comprising a generally rectangular front frame lying on a plane and a generally rectangular back frame lying on a plane, and the front frame and back frame each having a top end, a bottom end, and an outer surface;

an axle pivotally extending through the top ends to connect them together so that the plane of the front frame and the plane of the back frame both pass through the axle;

a set of two spaced brackets attached to the outer surface of the front frame, each of the two brackets opening upward to form a cradle space and having a width;

a spool-receiving bar for extending through the central hole of a spool, the bar rotatably received in the cradle spaces of the two brackets, the bar being removable from the brackets for convenient loading of the bar with the spool; and a guide connected to the A-frame, wherein the guide comprises a sleeve slidably extending around the axle, an extension from the sleeve having an extension outer end and a ring on the extension outer end, the ring having an aperture for receiving and guiding the wire, whereby the aperture is at a distance from the A-frame.

2. The caddy of claim 1, wherein the extension is sized so that the ring is positioned at about midway between the axle and the front frame bottom end.

3. An A-frame spool caddy comprising:

an A-frame comprising a generally rectangular front frame lying on a plane and a generally rectangular back frame lying on a plane, and the front frame and back frame each having a top end, a bottom end, a first side and a second side, and an outer surface, the front frame and back frame being pivotally connected together;

a set of two spaced brackets attached to the outer surface of the front frame;

a spool-receiving bar rotatably received in the two brackets so that the bar may be lifted out of the brackets;

a guide pivotally connected to the A-frame, the guide having an aperture at a distance from the A-frame, the aperture for receiving and guiding a wire, the guide comprising a sleeve slidably connected to the A-frame and adapted to slide from near the first side of said front and back frames to near the second side of said front and back frames.

4. The caddy of claim 3, wherein the A-frame comprises an axle extending through the top ends of the front frame and back frame, and wherein the sleeve slidably extends around the axle, an extension from the sleeve having an aperture on an extension outer end for receiving the wire.

5. The caddy of claim 4, wherein the extension outer end has a ring having the aperture, and the extension is sized so that the ring is positioned at about midway between the axle and the front frame bottom end.

6. The caddy of claim 3, wherein the bracket further comprises a slidable pin that extends through the bracket and the front frame above the bar.

7. The caddy of claim 3, wherein the brackets have a width, and wherein the bar has a first end, a second end, and radially-extending protrusions, said protrusions located only on said first end, said protrusions spaced from each other a distance about equal to the width of one bracket, wherein the protrusions extend on each side of, and in close proximity to, said one bracket to prevent sliding of the bar axially out of the bracket and to allow the bar to slide upwards out of the bracket.

8. The caddy of claim 7, wherein the protrusions comprise generally flat plates coaxial with the bar and extending perpendicularly from the bar.

9. The caddy of claim 7, further comprising a second spaced set of two brackets on the outer surface of the front frame, each of the two brackets opening upward to form a cradle space and having a width; and a second spool-receiving bar rotatably received in the cradle spaces of the second set of two brackets so that said second bar may be slid upwards out of the brackets, wherein the brackets have a width, and wherein the bar has a first end, a second end, and radially-extending protrusions, said protrusions located only on said first end, said protrusions spaced from each other a distance about equal to the width of one bracket, wherein the protrusions extend on each side of, and in close proximity to, said one bracket to prevent sliding of the second bar axially out of the bracket and to allow the bar to slide upwards out of the bracket.

10. The caddy of claim 7, wherein:

the back frame comprises a third spaced set of two brackets connected to the outer surface of the back frame, each of the two brackets opening upward to form a cradle space and having a width; and the caddy further comprises a back frame spool-receiving bar rotatably received in the cradle spaces of the third set of two brackets so that said back frame bar may be slid upwards out of the brackets, wherein the brackets have a width, and wherein the back frame bar has a first end, a second end, and radially-extending protrusions, said protrusions located only on said first end, said protrusions spaced from each other a distance about equal to the width of one bracket, wherein the protrusions extend on each side of, and in close proximity to, said one bracket to prevent sliding of the back frame bar axially out of the bracket and to allow said bar to slide upwards out of the bracket.

11. An A-frame spool caddy comprising:

an A-frame comprising a generally rectangular front frame lying on a plane and a generally rectangular back frame lying on a plane, and the front frame and back frame each having a top end, a bottom end, and an outer surface, the front frame and back frame being pivotally connected together;

a first bracket and a second bracket, said brackets having a width and attached to the outer surface of the front frame; and, a spool-receiving bar rotatably received in the two brackets, said spool-receiving bar having a first end and a second end;

wherein the first end of the bar comprises a plurality of radially-extending protrusions that are spaced from each other a distance about equal to the width of one bracket so that one protrusion is on each side of, and in close proximity to, the one bracket, wherein said protrusions prevent the sliding of the bar axially out of the brackets and allows the bar to slide upwards out of the brackets; and, wherein the second end of the bar comprises no radial protrusions so that spools can be slid onto and off of the second end.

12. The caddy of claim 11, wherein the protrusions comprise generally flat plates coaxial with the bar and extending perpendicularly from the bar.

13. An A-frame spool caddy comprising:

an A-frame comprising a generally rectangular front frame lying on a plane and a generally rectangular back frame lying on a plane, and the front frame and back frame each having a top end, a bottom end, and an outer surface, the front frame and back frame being pivotally connected together by an axle;

a set of two spaced brackets attached to the outer surface of the front frame; and, a spool-receiving bar rotatably received in the two brackets so that the bar may be lifted out of the brackets; and a connecting limit mechanism connecting the front frame to the back frame, said connecting limit mechanism consisting of two portions pivotally connected to the front and back frames and to each other and a locking mechanism for limiting the pivoting of the two portions relative to each other and limiting the pivoting of the front and back frame relative to each other around the axle.

* * * * *